US006589151B2

(12) United States Patent
Akatsu et al.

(10) Patent No.: US 6,589,151 B2
(45) Date of Patent: Jul. 8, 2003

(54) CENTRIFUGAL SEPARATOR CAPABLE OF READING A ROTOR IDENTIFICATION SIGNAL UNDER DIFFERENT ROTOR ROTATION CONDITIONS

(75) Inventors: Katsunori Akatsu, Hitachi (JP); Shinji Watanabe, Hitachinaka (JP); Takayuki Watahiki, Ibaraki-ken (JP)

(73) Assignee: Hitachi Koki Co., Ltd., Tokyo (JP)

( * ) Notice: Subject to any disclaimer, the term of this patent is extended or adjusted under 35 U.S.C. 154(b) by 43 days.

(21) Appl. No.: 09/842,910

(22) Filed: Apr. 27, 2001

(65) Prior Publication Data

US 2002/0160900 A1 Oct. 31, 2002

(51) Int. Cl.[7] ..... B04B 9/10; B04B 13/00
(52) U.S. Cl. ..... 494/7; 494/10
(58) Field of Search ..... 494/1, 7–12, 16, 494/20, 84; 340/671, 681, 870.34; 318/254; 388/809, 811, 814, 907.5, 912, 933

(56) References Cited

U.S. PATENT DOCUMENTS 3,462,670 A * 8/1969 Waye
4,551,715 A * 11/1985 Durbin
4,601,696 A * 7/1986 Kamm
4,700,117 A * 10/1987 Giebeler et al.
4,772,254 A * 9/1988 Grassl et al.
4,827,197 A * 5/1989 Giebeler
5,037,371 A * 8/1991 Romanauskas
5,221,250 A * 6/1993 Cheng
5,235,864 A * 8/1993 Rosselli et al.
5,338,283 A * 8/1994 Fleming et al.
5,382,218 A * 1/1995 Uchida
5,649,893 A * 7/1997 Inaniwa et al.
5,926,387 A * 7/1999 Furst
2002/0042334 A1 * 4/2002 Tetsu et al.

FOREIGN PATENT DOCUMENTS

DE 2559343 * 7/1977
GB 2240496 * 8/1991
JP 6-198219 7/1994
JP 10-34021 2/1998
JP 2001-46917 * 2/2001

* cited by examiner

*Primary Examiner*—Charles E. Cooley
(74) *Attorney, Agent, or Firm*—McDermott, Will & Emery

(57) ABSTRACT

Each of changeable rotors has an identification mark portion thereon. The identification mark portion is detected to generate an identification signal. A microprocessor starts and accelerates rotation of the motor, detects whether the identification signal is detected during acceleration of the rotor, detects whether the identification signal has been detected before the motor reaches a predetermined rotation speed, to provide detection of the identification mark portion by the ID sensor. The microprocessor cyclically detects whether the identification mark portion is detected during rotating the rotor at the steady state rotation speed. The user is informed of error when the microprocessor fails to detect the identification mark portion a predetermined number of times or within a predetermined interval.

3 Claims, 3 Drawing Sheets

CENTRIFUGAL SEPARATOR CAPABLE OF READING A ROTOR IDENTIFICATION SIGNAL UNDER DIFFERENT ROTOR ROTATION CONDITIONS

BACKGROUND OF THE INVENTION

1. Field of the Invention

This invention relates to a centrifugal separator with rotor identification mark detection.

2. Description of the Prior Art

A centrifugal separator having a rotor identifying sensor for identifying the rotor with identification marks on the rotor is known. The rotor identifying sensor detects the pattern of the identification marks during accelerating the rotor to generate an identification signal including the identification data of the rotor. Though this identifying sensor can detect the identification marks, the rotor identifying sensor may fail to detect the identification marks because vibrations occur in the rotor during acceleration due to rotor setting conditions or unbalanced conditions of samples.

Another type of rotor identifying sensor is disclosed in Japanese patent application provisional publication No. 6-198219. In this rotor identification sensor, on the bottom of a rotor, a plurality of magnetic positions, that are equiangular around the axis of the rotor, are predetermined. The pattern of present or absent magnets provides the identification data. Though this rotor identification sensor can detect the identification data irrespective of rotation and stopping, a plurality of sensor elements are required.

Still another type of rotor identifying sensor is disclosed in Japanese patent application provisional publication No. 10-34021.

FIG. 3 is a block diagram of this prior art centrifugal separator and FIG. 4 is a bottom view of the rotor used in this prior art centrifugal separator. The rotor 201 has a rotor identification adopter 202 mounted on the bottom of the rotor 202. The rotor identification adopter 202 has holes and flat surface portions as identification marks 203 at equiangular arranging positions along a circle on the bottom surface of the rotator identification adopter 202. The hatched circles in the drawing represents the holes and the circles without hatching represents the flat surface portions. The centrifugal separator further includes a sensor 204 to generate a detection signal indicating the detected holes and flat portions. The variation of the detection signal provided with rotation of the rotor 201 represents the pattern of the holes and the flat portions at the equiangular arrange positions. The variation of the detection signal provides the binary code with reference to a rotary position signal from a rotary encoder 211.

The rotor 201 is rotated by a motor 210. The detection signal from the sensor 204 and the rotary position signal from the rotary encoder 211 are supplied to a processing circuit 212 to be processed.

In the above-mentioned prior art centrifugal separators, it is general to read the identification marks on the rotor at a stabilized rotation speed of the rotor in consideration of vibration of the rotor.

SUMMARY OF THE INVENTION

The aim of the present invention is to provide a superior centrifugal separator.

According to the present invention, a first aspect of the present invention provides a centrifugal separator comprising: a motor for rotating one of changeable rotors, each of changeable rotors having an identification mark portion on each of said changeable rotors; driving means for driving said motor; identification mark detection means for detecting said identification mark portion to generate an identification signal; and control means for operating said driving means to start and accelerate rotation of said motor, detecting whether said identification signal is detected during acceleration of said rotor, detecting whether said identification signal has been detected before said motor reaches a predetermined rotation speed, and controlling said driver to rotate said motor at a steady state rotation speed (stabilized rotation speed) if identification signal has not been detected before rotation of said motor reaches a predetermined rotation speed, to provide detection of said identification mark portion by said identification mark detection means.

According to the present invention, a second aspect of the present invention provides a centrifugal separator based on the first aspect, wherein said control means cyclically detects whether said identification signal is detected during rotating said rotor at said steady state rotation speed, informing the user of an error when said control means fails to detect said identification signal a predetermined times.

According to the present invention, a third aspect of the present invention provides a centrifugal separator based on the first aspect, wherein said control means cyclically detects whether said identification signal is detected during rotating said rotor at said steady state rotation speed, informing the user of an error when said control means fails to detect said identification signal within a predetermined interval.

BRIEF DESCRIPTION OF THE DRAWINGS

The object and features of the present invention will become more readily apparent from the following detailed description taken in conjunction with the accompanying drawings in which.

DETAILED DESCRIPTION OF THE INVENTION

Figure 1:
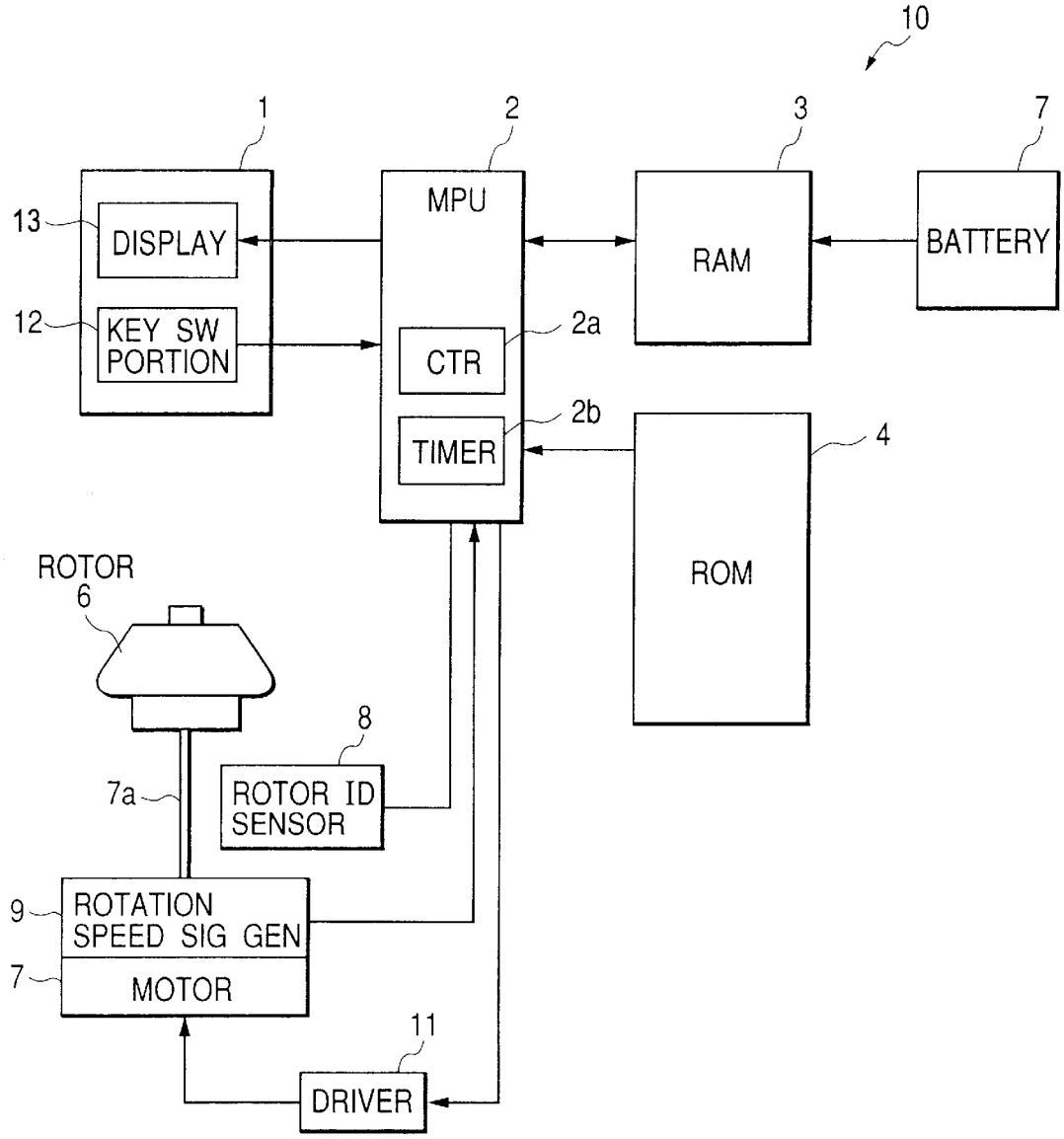
FIG. 1 is a block diagram of a centrifugal separator according to an embodiment.

FIG. 1 is a block diagram of a centrifugal separator according to an embodiment.

The centrifugal separator of the embodiment includes a (changeable) rotor 6 for containing a sample, a motor 7 for rotating the rotor 6, a shaft 7*a* for coupling the rotor 6 to the motor 7, a rotor identifying sensor 8, a rotation speed signal generator 8, and a control unit 10.

The control unit 10 includes an operation panel 1, a microprocessor 2, a ROM 3, a RAM 4, and a battery 5. The microprocessor 2 includes a counter 2*a* and a timer 2*b*.

A user sets a desirable rotor 6 to the motor shaft 7*a*. Next, the user starts rotating the rotor 6.

The rotor identifying sensor 8 detects the mark portion on the rotor 6 during rotation to generate the rotor identifying signal including identification data of the rotor 6.

The motor 7 includes a rotation speed signal generator 9 for generating a rotation speed signal and a position signal which are supplied to the microprocessor 2.

Figure 2:
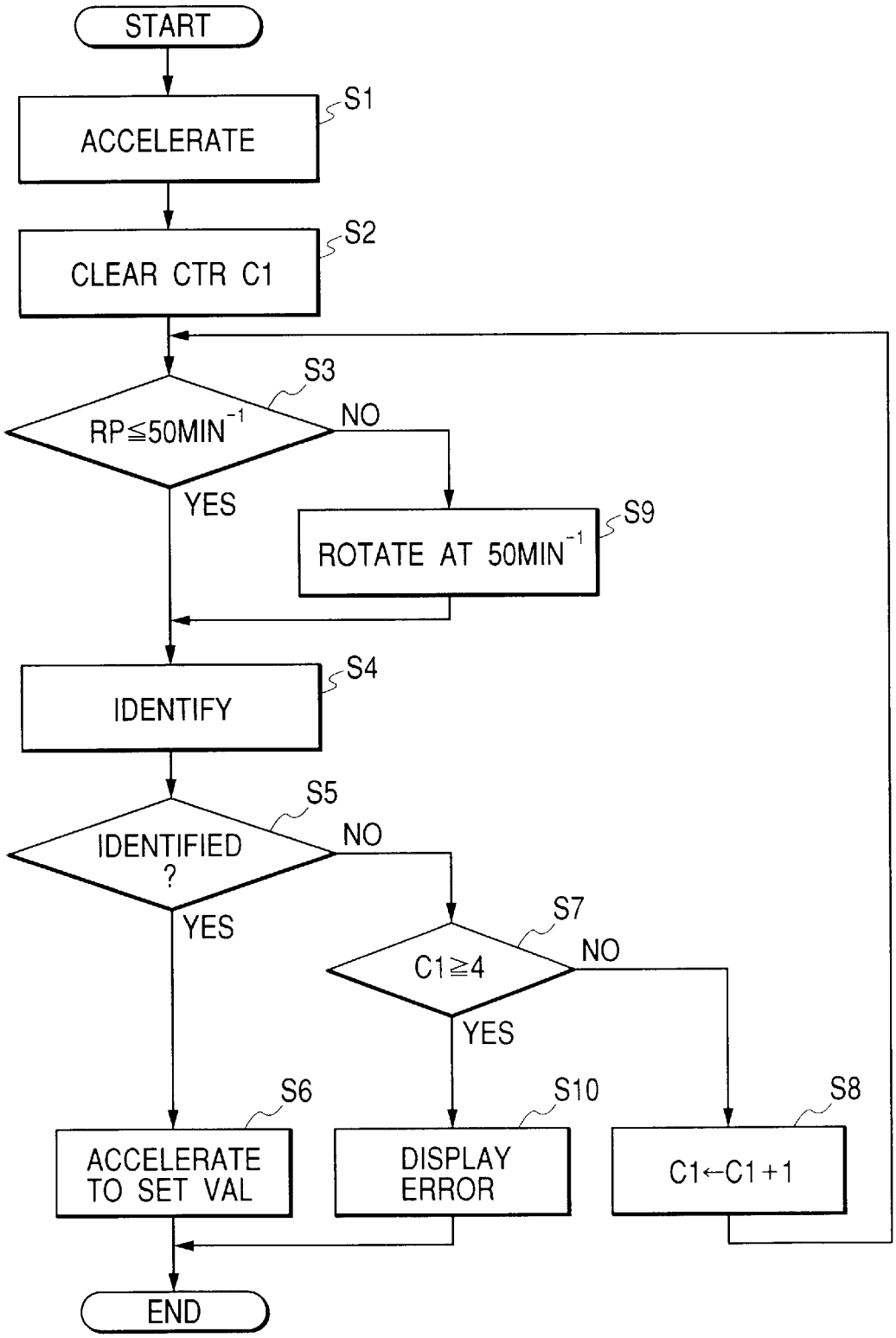
FIG. 2 depicts a flow chart showing identification mark detection judging operation according to this embodiment.
Figure 3:
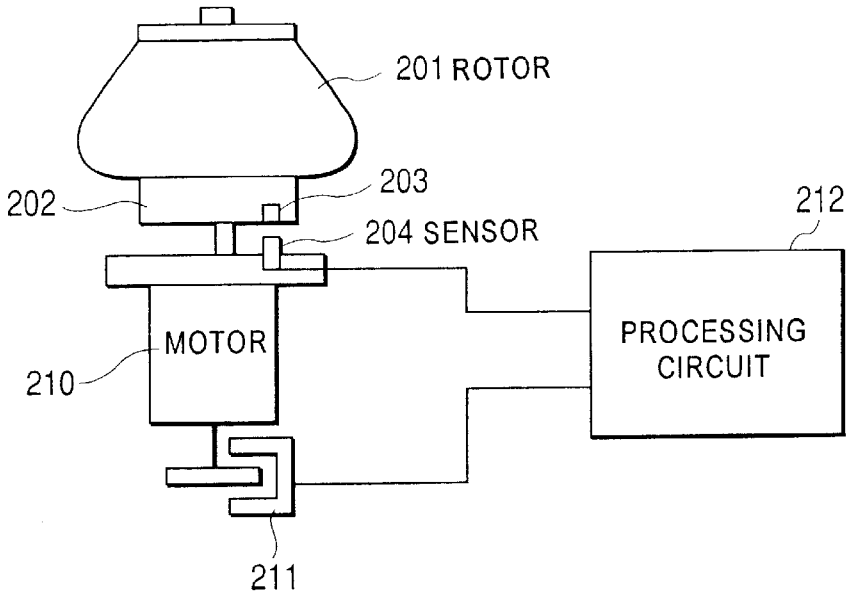
FIG. 3 PRIOR ART
FIG. 3 is a block diagram of a prior art centrifugal separator.
Figure 4:
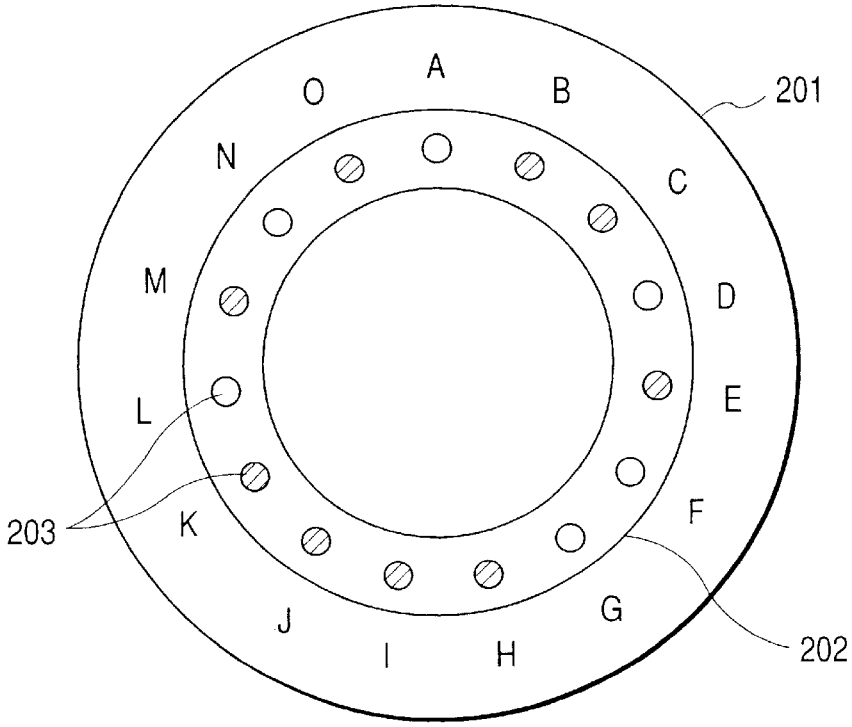
FIG. 4 PRIOR ART
FIG. 4 is a bottom view of the rotor used in the prior art centrifugal separator The same or corresponding elements or parts are designated with like references throughout the drawings.

FIG. 2 depicts a flow chart showing identification mark detection judging operation according to this embodiment.

In response to a start switch (not shown) on the operation panel 1, the microprocessor 2 operates the driver 11 to rotate the motor 7 in acceleration mode in step S1. The microprocessor 2 clears (resets) a counter (C1) 2*a* in step S2. The microprocessor 2 reads the rotation speed signal from the rotation speed signal generator 9 and compares the rotation speed signal with a predetermined value, for example, 50 $min^{-1}$ in step S3. If the rotation speed signal equal to or lower than the predetermined value in step S3, the microprocessor 2 reads the rotor identification signal from the rotor identification sensor 8 to obtain the identification data of the rotor 6 in step S4. In the following step S5, the microprocessor 2 judges whether the identification mark portion has been detected by checking the rotor identification signal in step S5. If the identification mark portion (identification signal) has been detected, the microprocessor 2 further accelerates the motor 7 up to the set value in step S6.

In step S3, if the rotation speed signal exceeds the predetermined value in step S3, the microprocessor 2 controls the driver 11 to rotate the motor 7 at the predetermined rotation speed in a steady state, for example, at 50 min−1 in step S9. That is, in step S9, the microprocessor 2 rotates the motor 7 at the predetermined rotation speed which is lower than the lowest setting speed before the identification mark portion has been detected. Next, the microprocessor 2 reads the rotor identification signal from the rotor identification sensor 8 to obtain the identification data of the rotor 6 in step S4 as mentioned above.

In step S5, if the identification mark portion has not been detected, the microprocessor 2 compares the count C1 with a predetermined number, for example, four, in step S7. If the count C1 is higher than four (NO), the microprocessor 2 displays an error message on the display 13 in step S10, and processing ends.

In step S7, if the count C1 is equal to or lower than four ($C1 \leqq 4$), the microprocessor 2 increments the count C1 in step S8. Next, processing returns to step S3.

In step S4, the rotor identification signal is detected for a predetermined interval using the timer 2*b* or during one rotation of the rotor 6 using the position signal. Thus, the rotor identification signal is cyclically detected a predetermined times with an interval. In other words, identification signal is detected for a predetermined interval.

In the above-mentioned embodiment, when the rotor 6 cannot be identified, the rotor 6 is rotated at a substantial constant rotation speed of 50 $min^{-1}$ in a steady rotation condition of the motor 7. However, this value is not always necessary but it is sufficient that this value is lower than the lowest setting speed. Further, the predetermined number compared with the count C1 can be varied as long as enormous detection of the identification signal due to noise or vibration of the rotor 6 is prevented. Moreover, when the user is informed of error, the user can input the identification data instead the identification signal with the key switch portion 12.

As mentioned above, the microprocessor 2 operates the driver 11 to start and accelerate rotation of the motor, detects whether the identification signal is detected during acceleration of the rotor, detects whether the identification signal has been detected before the motor reaches a predetermined rotation speed, and controls the driver 11 to rotate the motor 7 at a steady state rotation speed if identification signal has not been detected before rotation of the motor 7 reaches a predetermined rotation speed, to provide detection of the identification mark portion by the identification mark detection sensor 8.

Moreover, the microprocessor cyclically detects whether the identification signal is detected during rotating the rotor 6, and informs the user of an error when the microprocessor 2 fails to detect the identification signal a predetermined times or within a predetermined interval.

As mentioned above, according to this embodiment, at first, the microprocessor 2 reads the rotor identification signal from the rotor identification sensor 8 during acceleration. If the microprocessor 2 cannot read the rotor identification signal, that is, the microprocessor 2 cannot identify the rotor identification mark, during acceleration due to vibration of the rotor 6 or external noise, the microprocessor 2 rotates the rotor 6 at a steady state rotation speed (stops acceleration). Thus, the microprocessor 2 can read the rotor identification signal in the condition free from vibration or noise. Then, when the microprocessor 2 can read the identification signal, the microprocessor 2 accelerates the rotor 6 again to the target rotation speed. If the microprocessor 2 cannot read the identification signal while the rotor 6 rotates at the steady state rotation speed, the microprocessor 2 decelerates rotation of the rotor 6 to stop the rotor 6 or decelerates to a low speed and tries to detect the identification signal again. In this case, if the microprocessor 2 finally fails to read the identification signal, the microprocessor 2 stops the rotor 6.

What is claimed is:

1. A centrifugal separator comprising:

a motor for rotating one of changeable rotors, each of said changeable rotors having an identification mark portion on each of said changeable rotors;

driving means for driving said motor;

identification mark detection means for detecting said identification mark portion to generate an identification signal; and control means for operating said driving means to start and accelerate rotation of said motor, detecting whether said identification signal is detected during acceleration of said rotor, detecting whether said identification signal has been detected before said motor reaches a predetermined rotation speed, and controlling said driving means to rotate said motor at a steady state rotation speed if said identification signal has not been detected before rotation of said motor reaches said predetermined rotation speed, to provide detection of said identification mark portion by said identification mark detection means.

2. A centrifugal separator as claimed in claim 1, wherein said control means cyclically detects whether said identification signal is detected during rotating said rotor at said steady state rotation speed, informing the user of an error when said control means fails to detect said identification signal within a predetermined number of detection cycles.

3. A centrifugal separator as claimed in claim 1, wherein said control means cyclically detects whether said identification signal is detected during rotating said rotor at said steady state rotation speed, informing the user of an error when said control means fails to detect said identification signal within a predetermined interval.

* * * * *